US009932766B2

(12) United States Patent
Ellis et al.

(10) Patent No.: US 9,932,766 B2
(45) Date of Patent: Apr. 3, 2018

(54) ELECTRIC VAULT COVER

(71) Applicants: Michael A. Ellis, Chicago, IL (US); Bryan O. Washington, Chicago, IL (US)

(72) Inventors: Michael A. Ellis, Chicago, IL (US); Bryan O. Washington, Chicago, IL (US)

( * ) Notice: Subject to any disclaimer, the term of this patent is extended or adjusted under 35 U.S.C. 154(b) by 265 days.

(21) Appl. No.: 14/741,225

(22) Filed: Jun. 16, 2015

(65) Prior Publication Data

US 2016/0374146 A1 Dec. 22, 2016

(51) Int. Cl.

| | |
|---|---|
| ***H05B 3/00*** | (2006.01) |
| ***H05B 3/02*** | (2006.01) |
| ***H05B 3/06*** | (2006.01) |
| ***E06B 5/10*** | (2006.01) |
| ***H05B 1/02*** | (2006.01) |

(52) U.S. Cl.

CPC ..... *E06B 5/10* (2013.01); *H05B 1/0227* (2013.01); *H05B 1/0252* (2013.01); *H05B 3/02* (2013.01); *H05B 3/06* (2013.01); *H05B 3/00* (2013.01)

(58) Field of Classification Search

None

See application file for complete search history.

(56) References Cited

U.S. PATENT DOCUMENTS

| | | | | |
|---|---|---|---|---|
| 5,404,343 | A * | 4/1995 | Boggio | E04H 13/003 360/12 |
| 5,609,784 | A * | 3/1997 | Davenport | F16L 59/161 137/341 |
| 5,614,119 | A * | 3/1997 | Ollis | E03B 7/12 137/341 |
| 6,104,351 | A * | 8/2000 | Jones | H01Q 1/02 343/703 |
| 7,170,035 | B2 * | 1/2007 | Peterson | F24C 7/105 206/373 |
| 8,511,336 | B1 * | 8/2013 | Schumacher | F16K 35/10 137/343 |
| 2007/0243820 | A1 * | 10/2007 | O'Hagin | F24F 7/025 454/365 |
| 2007/0272305 | A1 * | 11/2007 | Schumacher | F16K 27/12 137/382 |
| 2010/0052353 | A1 * | 3/2010 | Shea | B60H 1/00592 296/37.16 |
| 2010/0277116 | A1 * | 11/2010 | Reichart | H01M 10/465 320/101 |
| 2011/0031233 | A1 * | 2/2011 | Pandelle | A47J 27/004 219/442 |

* cited by examiner

*Primary Examiner* — Joseph M Pelham
(74) *Attorney, Agent, or Firm* — Gregory B. Gulliver; Apogee Law Group P.C.

(57) ABSTRACT

An approach for creation of an electrical vault cover that is able to generate power that is stored in a battery for use by a heater to maintain the temperature above a minimum in a utility vault.

15 Claims, 3 Drawing Sheets

ELECTRIC VAULT COVER

FIELD OF THE INVENTION

This application relates to covers of utility vaults and more particular to heated utility vaults.

BACKGROUND

Many different types of utilities are placed underground, such as water, communication, and electricity. The utilities are typically accessed from the surface at predetermined locations where covered vaults have been placed. In northern claimants, the temperature in side of the vaults in the winter can drop below freezing. Some utilities are adversely affected by such low temperatures. For example, water freezes causing damage to pipes and/or reduced water pressure.

What is needed in the art is an approach for maintaining the temperature in a vault above a freezing.

SUMMARY

In accordance with one embodiment of the disclosure, an approach for maintaining the temperature inside of a utility vault above a predetermined minimum is described. The approach utilizes a heater that may be solar powered to maintain a minimum temperature and a batter to store and supply power to the heater. An alarm monitor may monitor the vault and report a failure of the batter, heater, or temperature dropping below the predetermined amount. Further, an alarm may also signal the vault is being accessed.

The above described features and advantages, as well as others, will become more readily apparent to those of ordinary skill in the art by reference to the following detailed description and accompanying drawings. While it is desirable to provide a heater and power supply in a vault, the teachings disclosed herein also extend to those embodiments which fall within the scope of the appended claims, regardless of whether they accomplish one or more of the above-mentioned advantages.

DESCRIPTION

An example embodiment of a utility vault having a power supply and heater to monitor and maintain a temperature is described.

Figure 1:
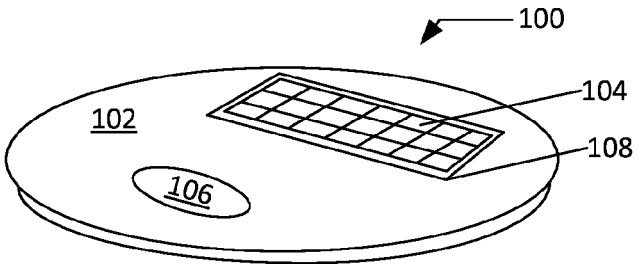
FIG. 1 is an exemplary top view depiction of a vault cover having a solar panel and transmitter in accordance with an example implementation of the invention.

In FIG. 1, an exemplary top view depiction 100 of a vault cover 102 having a solar panel 104 and transmitter 106 is shown in accordance with an example implementation of the invention. The vault cover 102 has one or more solar panels 102 attached to or integrated into the vault cover 102. The solar panels 104 may be secured to the vault cover 102 by fasteners, such as screes or rivets. In other implementations the solar panel 104 may be secured to the vault cover by an adhesive. The solar panels 104 may be an assembly of solar panels and an associate cover 108 that allows light to pass through, such as Plexiglas, glass brick, or CORNING'S GORILLA GLASS®. In other implementation, the cover 108 may be independent of the solar panels 104 and secured to the vault cover 102 over the solar panels 104. The vault cover 102 may also have a portion of a transmitter 106 accessible via the top of the vault cover 102. An antennae coupled to the transmitter may also be in the portion of the transmitter 106 accessible via the top of the vault 102. In other implementations, the transmitter may be integrated into the vault cover 102 or attached to the underside (portion in the vault) of the vault cover 102.

Figure 2:
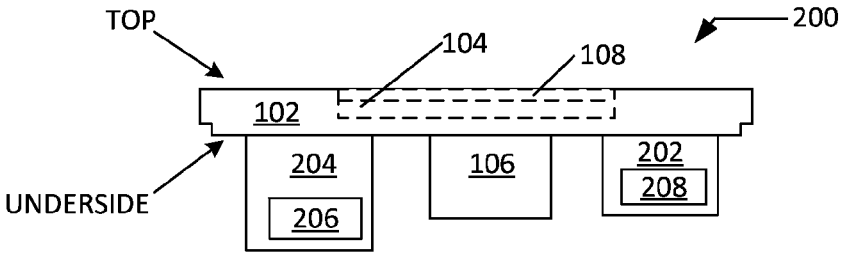
FIG. 2 is an exemplary side view depiction of the vault cover having a solar panel and transmitter of FIG. 1 in accordance with an example implementation of the invention.

Turning to FIG. 2, an exemplary side view depiction 200 of the vault cover 102 having a solar panel 104 and transmitter 106 of FIG. 1 is shown in accordance with an example implementation of the invention. The underside of the vault cover 102 has a battery compartment 202, transmitter 106, and heater 204. The heater 204 may have an associated fan 206. The fan 206 may be active when the heater is generating heat and for a time period after heat generation has stopped.

The battery compartment 202 may hold one or more batteries 208 coupled in series or in parallel depending upon the battery type and current/voltage needed for operation of the heating element and the duration of required operation. In other implementations the battery compartment 202 may be a strap, band, or other securing approach to secure the batteries 208 to the vault cover 102.

Figure 3:
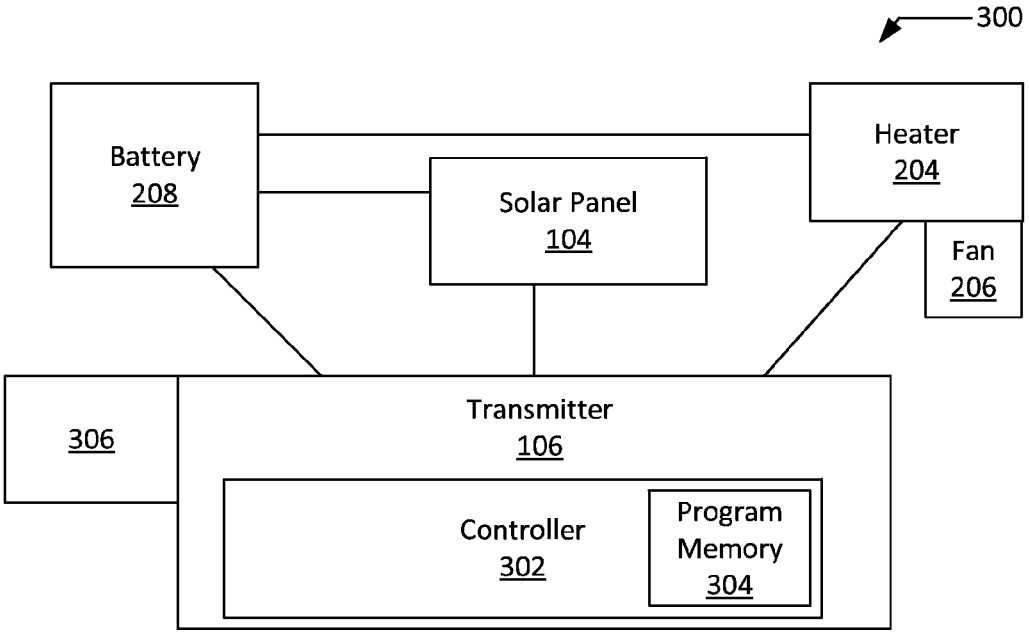
FIG. 3 is an exemplary component block diagram of the vault cover having a solar panel and transmitter of FIG. 1 in accordance with an example implementation of the invention.

In FIG. 3, an exemplary component block diagram 300 of the vault cover 102 having a solar panel 104 and transmitter 106 of FIG. 1 is depicted in accordance with an example implementation of the invention. The solar panel 104 may be coupled to a battery 208 and controlled by controller 302 to assure over charging of the battery does not occur. The battery may also power the transmitter 106 and associated controller 302 and heater 204 with associated fan 206.

The transmitter 106 may be implemented as a cellular transmitter using a chipset manufactured by BROADCOM® and be controlled via a controller 302. The transmitter 106 may be preconfigured to transmit to a predefined number when reporting operational or alarm status. The transmitter may also have sensors, such as a thermostat 306 for monitoring temperature in the vault and supplying the sensor data to the controller 302.

The controller 302 is shown as implemented with program memory 304 that stores the instructions for the operation of the vault cover 102. In other implementations, the controller 302 and program memory may be implemented as a separate controller from the controller used in the transmitter 106. In yet other implementations, the sensors 306 may be implemented independently from the transmitter 106 while still communicating with the controller. In the current implementation the electronic components are implemented on a single circuit board having the transmitter 106 in order to reduce complexity of assembly of the vault cover 102. The controller 302 may be implemented as an ARM processor, microprocessor, microcontroller, digital signal processor, or discrete circuits functioning as a state machine.

Figure 4:
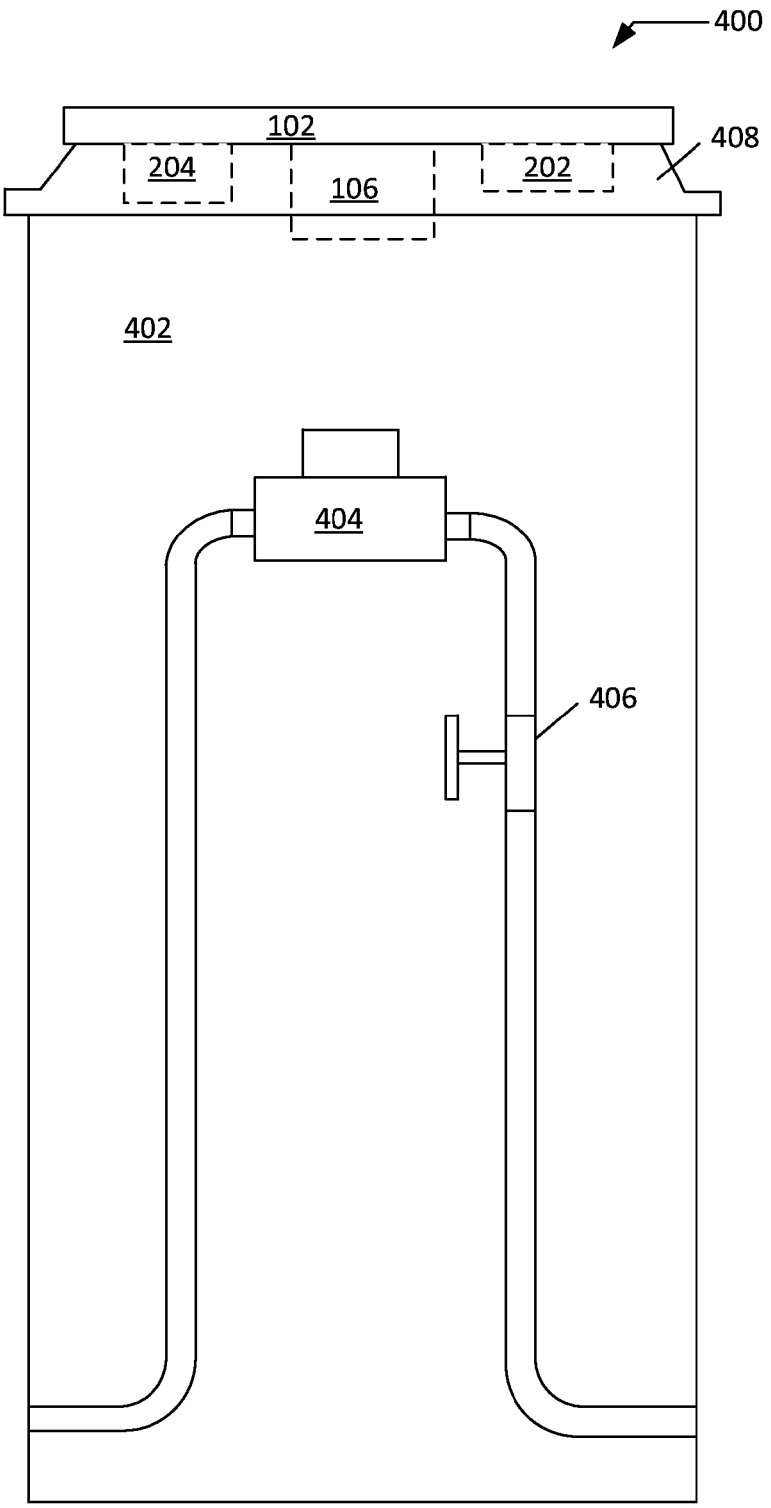
FIG. 4 is an exemplary depiction of the vault cover of FIG. 1 placed on top of a utility vault in accordance with an example implementation of the invention.

Turning to FIG. 4, an exemplary depiction 400 of the vault cover 102 of FIG. 1 placed on top of a utility vault 402 is shown in accordance with an example implementation of the invention. The vault cover 102 is shown with the battery compartment 202, heater 204, and transmitter 106. The vault 402 may contain a water meter 404 and shutoff valve 406 and associated piping. The vault 402 may have a top ring 408 that fits between the vault 402 and the vault cover 102. When the temperature sensor or thermostat 306 detects the temperate dropping below a predetermined minimum 34 degrees, the controller 302 turns on the heater 204 and associated fan 206. If a fault is detected such as batter is below a voltage threshold, solar panel is not generating power, fan fail, or other similar detectable faults; the transmitter 106 may call a monitoring center and report the error. In other implementations, a wireless network transmitter may be employed and the faults and/or status may be reported to an operations and maintenance center (OMC).

Figure 5:
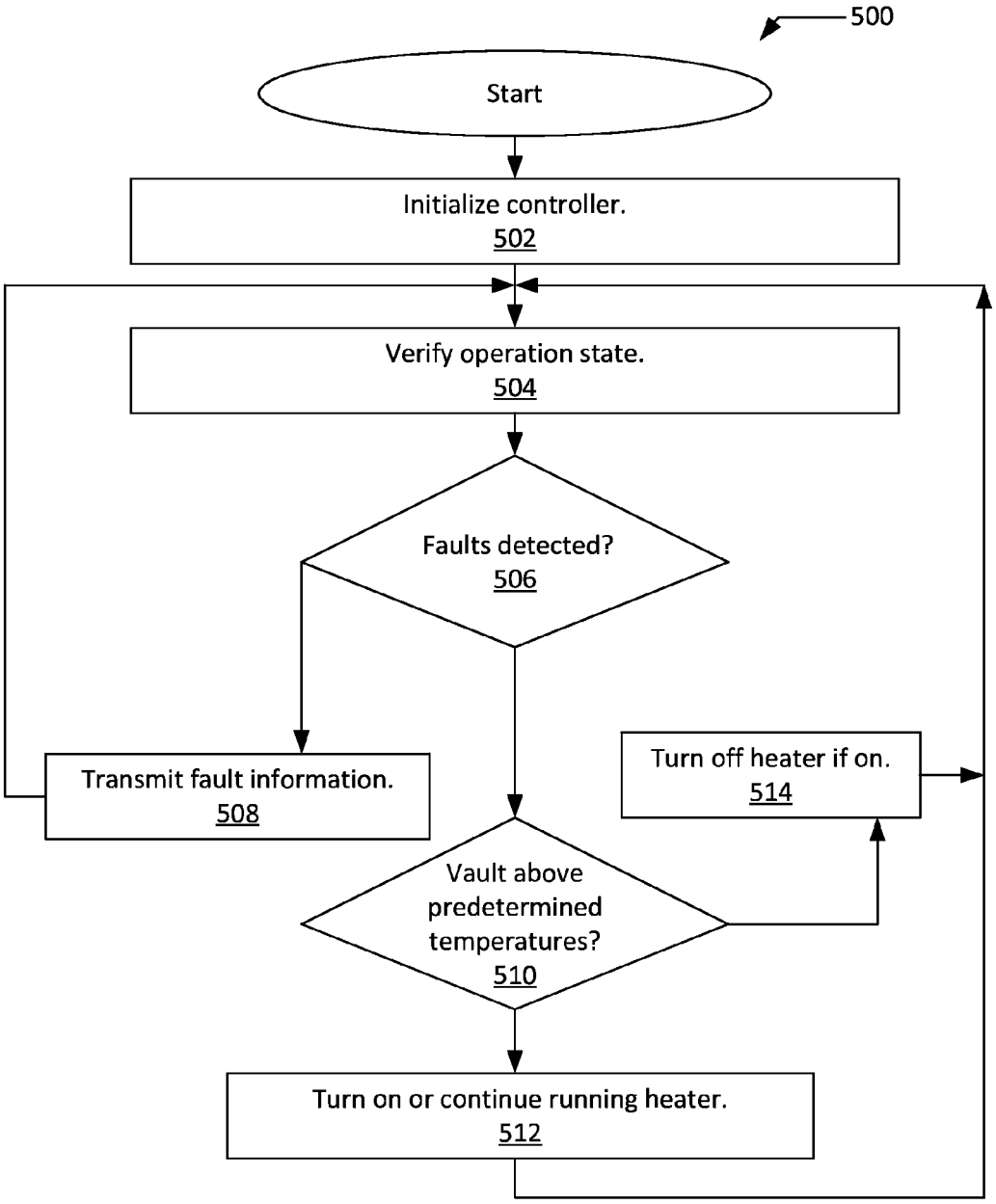
FIG. 5 is a flow diagram of an approach for operation of the vault cover of FIG. 1 in accordance with and example implementation of the invention.

In FIG. 5, a flow diagram 500 of an approach for operation of the vault cover 102 of FIG. 1 is depicted in accordance with and example implementation of the invention. The controller 302 is initialized and the instructions stored in program memory 304 are loaded in step 502. The operational state of the battery 202, solar panel 104, heater 204, fan 206, sensor 306 and transmitter 106 may be verified in step 504. If one or more faults are detected, in step 506, the fault information or data is transmitted by transmitter 106 in step 508. If the fault is in the transmitter 106, the controller 302 may store the fault data for retrieval when the controller is directly accessed. In other implementations, a ping message may be sent out at predetermined intervals by the transmitter to single to an OMC that the transmitter 106 and controller 302 are functioning properly.

The sensor or thermostat 306 sends temperature or sensor data to the controller 302 and the controller verifies that the temperature is above a predetermined minimum in step 510. In other implementations, the temperature may be measured by voltage or resistance with voltage or resistance values being compared to determine if a temperature minimum has been attained. If the minimum temperature has been detected in step 510, the heater 204 and fan 206 may be activated to generate heat. The operation may then be verified gain in step 504. Once a second temperature is reached in the vault, in step 510, the heater is turned off (if on) in step 514.

It is noted that part of initializing the controller 502 is regulating the voltage generated by the solar panel 104 for recharging the batter 208. In other implementations the operation of the heater 204 and fan 206 may be modified by an operational profile based upon the voltage or power of the batter. The less power, the slower the fan will operate and shorter the heating cycles.

It will be understood, and is appreciated by persons skilled in the art, that one or more processes, sub-processes, or process steps described in connection with FIG. 5 may be performed by hardware and/or software (machine readable instructions). If the approach is performed by software, the software may reside in software memory (not shown) in a suitable electronic processing component or system such as one or more of the functional components or modules schematically depicted in the figures.

The software in software memory may include an ordered listing of executable instructions for implementing logical functions (that is, "logic" that may be implemented either in digital form such as digital circuitry or source code or in analog form such as analog circuitry or an analog source such an analog electrical, sound or video signal), and may selectively be embodied in any computer-readable medium for use by or in connection with an instruction execution system, apparatus, or device, such as a computer-based system, processor-containing system, or other system that may selectively fetch the instructions from the instruction execution system, apparatus, or device and execute the instructions. In the context of this disclosure, a "computer-readable medium" is any tangible means that may contain or store the program for use by or in connection with the instruction execution system, apparatus, or device. The tangible computer readable medium may selectively be, for example, but is not limited to, an electronic, magnetic, optical, electromagnetic, infrared, or semiconductor system, apparatus or device. More specific examples, but nonetheless a non-exhaustive list, of tangible computer-readable media would include the following: a portable computer diskette (magnetic), a RAM (electronic), a read-only memory "ROM" (electronic), an erasable programmable read-only memory (EPROM or Flash memory) (electronic) and a portable compact disc read-only memory "CDROM" (optical). Note that the computer-readable medium may even be paper (punch cards or punch tape) or another suitable medium upon which the instructions may be electronically captured, then compiled, interpreted or otherwise processed in a suitable manner if necessary, and stored in a computer memory.

The foregoing detailed description of one or more embodiments of the approach for electric vault cover has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

The invention claimed is:

1. A vault cover, comprising:

a solar panel that generates power;

a battery;

a heater; and a controller coupled to the solar panel, batter and heater, where the controller activates the heater upon a predetermined minimum temperature is detected, where the solar panel, battery, heater, and controller are located on the vault cover and the vault cover is a utility vault cover.

2. The vault cover of claim 1, includes a transmitter that transmits fault data when a fault is detected by the control.

3. The vault cover of claim 2, where the transmitter is a wireless network transmitter.

4. The vault cover of claim 3, where the transmitter is a cellular network transmitter.

5. The vault cover of claim 1, includes a sensor coupled to the controller where the sensor sends sensor data to the controller.

6. The vault cover of claim 5, where the sensor is a thermostat.

7. The vault cover of claim 1, where the heater further includes a fan.

8. The vault cover of claim 1 where the power generated by the solar panel is used to recharge the battery.

9. The vault cover of claim 8, where the controller regulates the power from the solar panel used to recharge the battery.

10. A method for covering a vault, comprising:

monitoring temperature with a controller coupled to a vault cover, where the vault cover is a utility vault cover, and;

activating a heater controlled by the controller in response to the temperature in order to maintain a minimum temperature in the vault, where the heater and controller are powered from a battery that is charged via a solar panel; and placing the solar panel, battery, heater, and controller on the vault cover.

11. The method of claim 10, includes transmitting fault data with a transmitter coupled to the controller.

12. The method of claim 11, where the transmitter is a wireless network transmitter.

13. The method of claim 12, where the wireless network transmitter is a cellular network transmitter.

14. The method of claim 10, where monitoring temperature includes, sensing temperature with a thermostat.

15. The method of claim 10, includes regulating the power from the solar panel with the controller.

* * * * *